United States Patent [19]

Cross

[11] 4,445,730

[45] May 1, 1984

[54] SPEAKER CABINET

[76] Inventor: Jimmie R. Cross, R.R. #1, Box 646, Shirley, Ind. 47384

[21] Appl. No.: 288,306

[22] Filed: Jul. 30, 1981

[51] Int. Cl.[3] ..... A47B 81/06

[52] U.S. Cl. ..... 312/214; 312/257 SK

[58] Field of Search ..... 312/7.1, 7.2, 214, 257 SK, 312/257 R; 106/109, 110; 181/146, 151, 175, 290, 294

[56] References Cited

U.S. PATENT DOCUMENTS

| | | | |
|---|---|---|---|
| 1,803,445 | 5/1931 | Walper | 106/110 |
| 1,804,306 | 5/1931 | Bender | 181/31 |
| 2,063,224 | 12/1936 | Bawles | 312/7.1 |
| 2,793,781 | 5/1957 | Morton | 312/214 X |
| 2,866,514 | 12/1959 | Weathers | 181/151 |
| 2,903,084 | 9/1959 | Johnson | 181/31 |
| 3,326,321 | 6/1967 | Valuch | 181/31 |
| 3,430,728 | 3/1967 | Dunning | 181/31 |
| 3,473,625 | 10/1969 | Heisrath | 181/146 X |
| 3,528,103 | 5/1971 | Lennes | 181/151 X |
| 3,985,200 | 10/1976 | Sepmeyer | 181/199 |
| 4,114,065 | 9/1978 | Horvay | 312/214 |
| 4,167,985 | 9/1979 | Dunlavy | 181/148 |
| 4,190,305 | 2/1980 | Knight et al. | 312/214 |
| 4,206,956 | 6/1980 | Lydmar | 312/257 |
| 4,213,515 | 7/1980 | Laupman | 181/145 |

FOREIGN PATENT DOCUMENTS 838815 7/1949 Fed. Rep. of Germany ..... 181/285

OTHER PUBLICATIONS

Newspaper article by Greg W. White, *Anderson Herald*, 12-11-1977.

Data Sheets of Hydraulic Press Brick Company entitled "Production Process-The Haydite Story" and Structural Concrete Mix Design.

Brochure of the U.S. Gypsum Company entitled "What Gypsum Plasters Can Do for You".

*Primary Examiner*—William E. Lyddane
*Assistant Examiner*—Joseph Falk
*Attorney, Agent, or Firm*—Arnstein, Gluck, Lehr, Barron & Milligan

[57] ABSTRACT

A speaker cabinet comprising a cabinet with a resonance resistant liner. The cabinet has an opening in direct communication with a sound chamber which is designed to emit sound waves through the opening with the liner being adapted to substantially preclude any resonance in the cabinet. Specifically, the liner is adapted to reinforce the cabinet to achieve this objective.

10 Claims, 4 Drawing Figures

SPEAKER CABINET

FIELD OF THE INVENTION

The present invention relates to speaker cabinets and, more particularly, to a speaker cabinet comprising a cabinet with a resonance resistant liner.

BACKGROUND OF THE INVENTION

Conventional speaker systems are often formed, for instance, from a material such as wood particle board. It is characteristically the case that the cabinet is box-like in appearance, covered with a suitable wood or plastic veneer, and has an opening in the front thereof leading into what constitutes a sound chamber, the opening usually being covered by a grill cloth, a polyurethane foam pad, or some other equally effective and aesthetically pleasing material or device. Moreover, conventional speaker systems usually include one or more drivers mounted within the sound chamber in confronting relation to the opening in the cabinet.

While the evolution of speaker systems has been significant, it has remained difficult to match a driver and a cabinet in a highly predictable fashion. It is true, of course, that theoretical formulas have been developed for this purpose utilizing the measurements of a given driver, the volume of the cabinet, the cabinet tuning, the bass cutoff, the system efficiency, etc., and the basic theoretical formulas have been further refined and expanded by the use of computer techniques. Despite this knowledge, the state of the art has not advanced significantly in recent years due to a particularly vexing problem.

Specifically, speaker cabinets oftentimes resonate in conventional speaker systems. This has proven to be true, not only with particle board cabinets, but also with cabinets made from other conventional materials for speakers such as solid wood, plastic and the like, with the result that conventional speaker systems characteristically have higher distortion and lower efficiency than would ideally be the case. In order to overcome the resonance problem, attempts have been made to utilize sound absorbing or damping materials with cabinets.

Among the numerous attempts to alleviate the problems associated with resonating cabinets by means of the use of sound absorbing or damping materials are those disclosed in U.S. Pat. Nos. 4,213,515; 4,167,985; 3,430,728; 3,326,321; and 2,903,084.

Unfortunately, the numerous attempts to overcome the problem of resonating cabinets in speaker systems have been less than completely satisfactory for a common reason. They have all failed to recognize that, while the sound absorbing or damping materials may serve to absorb sound waves that might otherwise cause vibrations or resonance in the cabinet, this material has usually been less than totally effective in preventing resonance of the cabinet constructed, for instance, of wood particle board which has a tendency to resonate at relatively low frequency, and the sound absorbing or damping material also absorbs a portion of the sound wave energy intended to be emitted from the speaker system for the listening pleasure of those utilizing the system, rather than resisting the potential resonance inducing characteristics of the sound waves. Stated simply, it has not previously been recognized that the most advantageous way of dealing with the problem of resonating cabinets in speaker systems is to utilize a reinforcing liner to resist resonance by providing a rigid, well-braced box.

Accordingly, it is an object of the present invention to provide a speaker cabinet comprising a cabinet with a resonance resistant liner.

Another object of the present invention is the provision of a speaker cabinet of the type described wherein the resonance resistant liner is adapted to reinforce the cabinet to substantially preclude resonance.

A further object of the present invention is the provision of a speaker cabinet of the type described wherein the resonance resistant liner does not absorb sound wave energy in order to substantially preclude resonance.

Still another object of the present invention is the provision of a speaker cabinet of the type described wherein the sound chamber within the cabinet is substantially lined with a cement-like mixture.

These and other objects, features and advantages of the present invention will become apparent from the following description when considered in connection with the accompanying drawings.

SUMMARY OF THE INVENTION

In general, the objects and advantages of the present invention are met by providing an improved speaker cabinet comprising a cabinet with a resonance resistant liner. The cabinet has an opening in direct communication with a sound chamber which is designed to emit sound waves through the opening with the liner being adapted to substantially preclude any resonance within the cabinet. With these features of construction, the liner is adapted to reinforce the cabinet in a fashion not requiring the absorption of sound wave energy to achieve this objective.

In a preferred embodiment, the cabinet has a substantially continuous outer surface defining the shape thereof. Specifically, the cabinet preferably includes a plurality of walls defining a box-like enclosure, the walls intersecting at substantially right angles, and the box-like enclosure including a top wall, a bottom wall, a back wall, and a pair of side walls. Moreover, the cabinet includes a plurality of corner braces defining a box-like frame.

With respect to the reinforcing liner, it preferably comprises a layer of resonance resistant material laminated to each of the walls. The resonance resistant material is disposed on the walls between the corner braces which, advantageously, intersect at substantially right angles such that the box-like frame includes one of corner braces disposed at the intersection of each pair of the walls. Additionally, the resonance resistant material is preferably a gypsum cement and shale mixture with the content of shale per unit volume of the mixture falling within the range of between zero percent and fifty percent.

Preferably, the reinforcing layer is substantially coextensive with the inner surface of the cabinet. In order to secure a reinforcing layer to each of the walls, the walls are provided with a plurality of holes which are larger near the outer surface of the cabinet than near the inner surface thereof and are sized and shaped to receive the gypsum cement and shale mixture therein. In particular, the holes in the walls of the cabinet are preferably frustoconical in shape to retain the layers of resonance resistant material on the walls.

DETAILED DESCRIPTION OF THE PREFERRED EMBODIMENT

Figure 1:
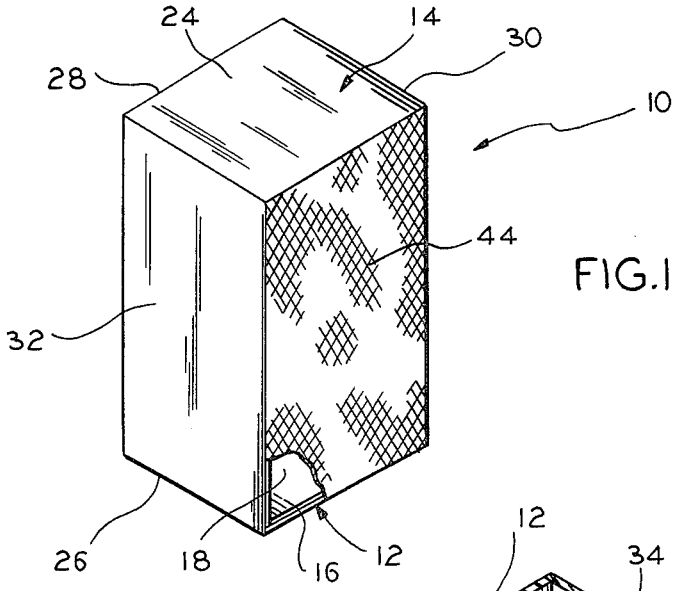
FIG. 1 is a perspective view of a speaker cabinet accordance with the present invention.

Referring to the drawings, and first to FIG. 1, the reference numeral 10 designates generally a speaker cabinet in accordance with the present invention. The speaker cabinet 10 includes a box-like enclosure 12 having a substantially continuous outer surface 14 defining the shape thereof. The box-like enclosure 12 has an opening 16 in direct communication with a sound chamber 18 designed to emit sound waves through the opening 16. The speaker cabinet 10 also includes means for reinforcing the cabinet 12, such as the reinforcing liner 20 shown in FIG. 2, to substantially preclude resonance in the cabinet. As will be appreciated, the reinforcing liner 20 is substantially coextensive with the inner surface 22 of the box-like enclosure 12.

Referring again to FIG. 1, the cabinet 10 includes a plurality of walls defining the box-like enclosure 12. In the preferred embodiment, the walls intersect at substantially right angles. As shown, the box-like enclosure 12 includes a top wall 24, a bottom wall 26, a back wall 28, and a pair of side walls 30 and 32.

Figure 2:
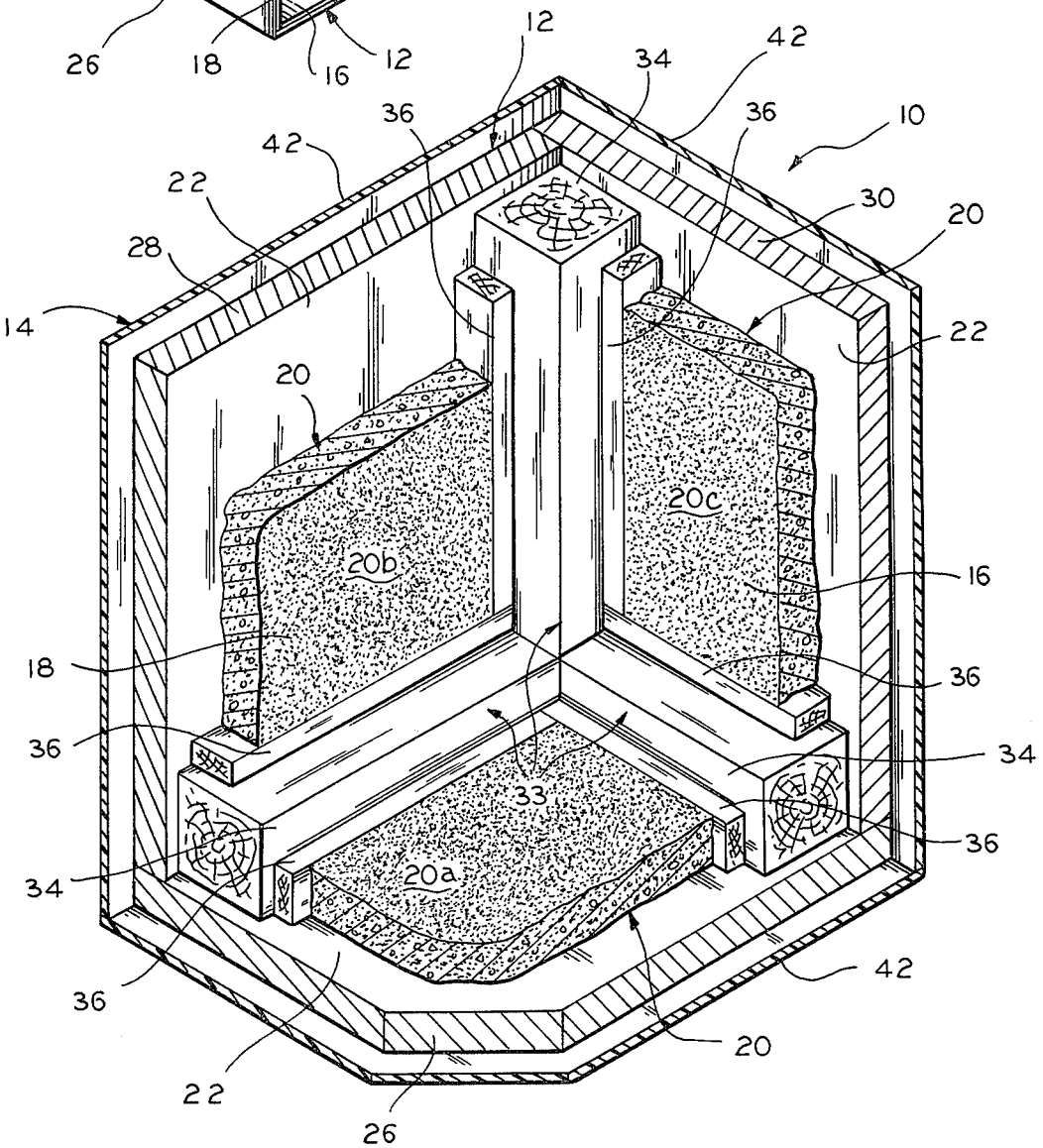
FIG. 2 is a cut-away perspective view of the speaker cabinet shown in FIG. 1.

Referring now to FIG. 2, the cabinet 10 includes a box-like frame 33 defined by a plurality of corner braces 34. The corner braces 34 intersect at substantially right angles in a preferred embodiment and are preferably formed of a substantially incompressible material for a reason to be discussed hereinafter. As shown, the box-like frame 33 includes one of the corner braces 34 disposed at the intersection of each pair of the walls, e.g., bottom wall 26 and back wall 28.

It will be appreciated from FIG. 2 that the reinforcing liner includes a layer of resonance resistant material laminated to each of the walls. The resonance resistant material, such as layers 20*a*, 20*b*, 20*c*, etc., are disposed on the walls (such as walls 26, 28 and 30) between the respective corner braces 34. However, the resonance resistant material is separated from the respective corner braces 34 by means of expansion joints 36 suitably formed of a compressible material.

Figure 3:
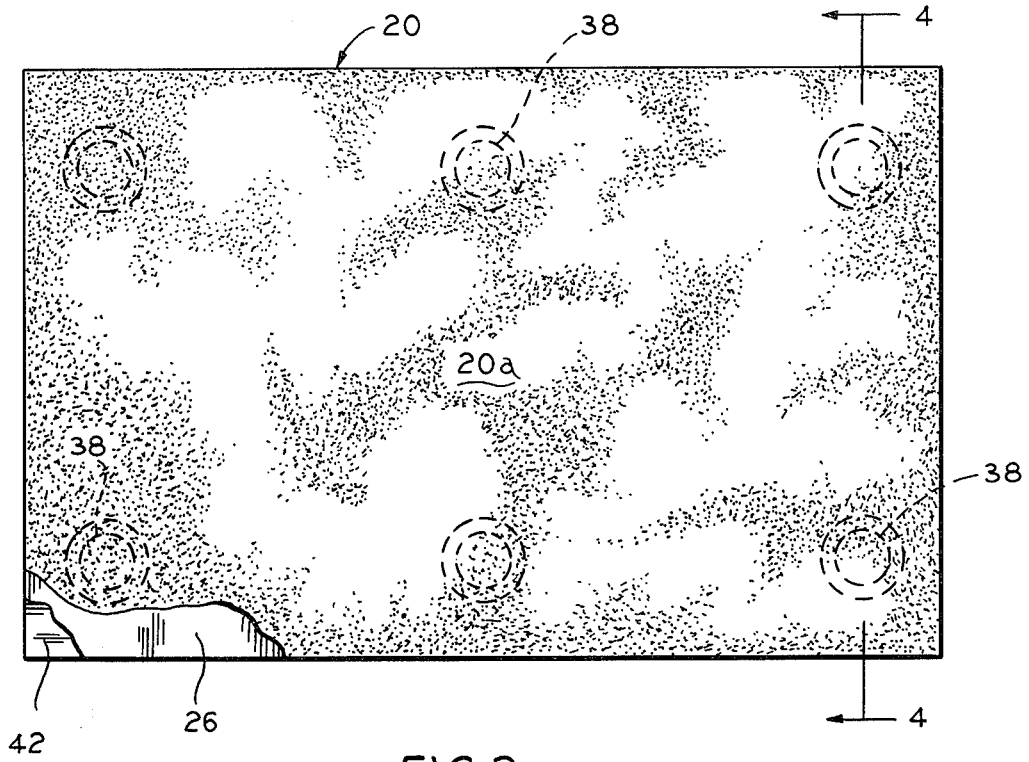
FIG. 3 is a plan view of a wall of the speaker cabinet shown in FIG. 1.
Figure 4:
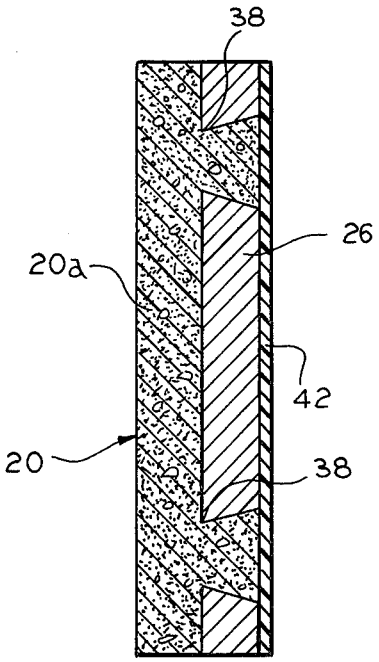
FIG. 4 is a cross-sectional view taken on the line 4—4 of FIG. 3.

Preferably, the resonance resistant material is a gypsum cement and shale mixture with the content of shale per unit volume of the mixture falling within the range of between zero percent and fifty percent. The box-like enclosure 12 includes a plurality of holes 38 in the walls thereof (such as wall 26 in FIGS. 3 and 4), the holes 38 being larger near the outer surface 14 of the box-like enclosure 12 than near the inner surface 22 and the holes are sized and shaped to receive the gypsum cement and shale mixture therein. Preferably, the holes 38 in the walls of the box-like enclosure 12 are frustoconical in shape and serve to retain the layers of resonance resistant material on the walls.

Referring to FIG. 2, the cabinet 10 includes a veneer 42 applied to the outer surface 12 of the box-like enclosure 12. The veneer 42, which can be any suitable material such as wood or plastic, is applied to the walls 24, 26, 28, 30 and 32 so as to substantially entirely cover the walls to give a pleasing appearance to the speaker cabinet. Referring now to FIG. 1, the opening 16 in the front of the cabinet 12 is suitably covered with a cloth or foam pad 44.

With respect to the materials preferred for the speaker cabinet 10, it has been found advantageous to utilize high density particle board for the walls 24, 26, 28, 30 and 32. It is preferred that the high density particle board be of the type commonly used by cabinet makers, and the corner braces 34 be formed of kiln dried hardwood to provide a sturdy frame for the walls which can be attached to the box-like frame in conventional fashion. As for the expansion joints 36, it has been found advantageous to utilize a softwood such as pine.

While the dimensions of the speaker cabinet 10 will vary in the usual fashion depending upon the system characteristics, it has been found advantageous for the high density particle board to be nominal $\frac{3}{8}$ inch thick. The reinforcing liner is preferably nominal $\frac{1}{2}$ inch thick with the veneer being approximately 0.06 inch thick. With respect to the frame, it has been found advantageous to use nominal 1 inch by 1 inch thick stock for this portion of the speaker cabinet.

With regard to the frusto-conical holes 38, a preferred inner surface dimension is nominal $\frac{3}{8}$ inch diameter with a 15 degree outward taper toward the outer surface. This has proven to adequately secure the reinforcing liner to the cabinet. Of course, the spacing and number of the holes will depend upon the size of the cabinet, although a nominal $2\frac{1}{2}$ inch on center spacing has been found fully adequate.

With regard to the expansion joints 36, it will be appreciated that the depth of the joints will be approximately equal to the thickness of the liners, as shown in FIG. 2. In other words, the depth of the expansion joints 36 will suitably be approximately nominal $\frac{1}{2}$ inch when the thickness of the liners is nominal $\frac{1}{2}$ inch, and it has been found that the thickness of the expansion joints 36 can suitably be approximately nominal $\frac{1}{4}$ inch. Of course, it will again be recognized by those skilled in the art that these dimensions are merely representative of a preferred embodiment.

With regard to specific materials, the corner braces 34 are suitably formed of a hardwood such as oak. As previously stated, the expansion joints are preferably formed of a softwood such as pine in order to take up the expansion which occurs in the gypsum cement/shale mixture in a linear direction along the walls in order to maintain the critical internal dimensions of the sound chamber 18 as the gypsum cement/shale mixture sets. With respect to the veneer 42, it has been found desirable to utilize material such as that sold under the trademark "FORMICA" by Formica Corporation although other materials including wood veneer are advantageously utilized, as well.

With respect to the reinforcing liner, it is contemplated that any of the gypsum cements and/or industrial plasters can successfully be utilized. Moreover, while it is believed that the gypsum cements and/or industrial plasters available from United States Gypsum are well suited for the intended purpose, the invention is not to be limited in any regard to a specific material but contemplates all materials comprising cement-like mixtures or having cement-like or plaster-like properties. As for the shale, it has been found advantageous to utilize a material such as that sold under the trademark "HAY- DITE" by Hydraulic Press Brick Company although other materials of this type are clearly contemplated, as well.

Utilizing the features of the present invention, it is now possible to provide a speaker system characterized by low distortion, low bass response, and high efficiency. This is believed to be accomplished by reason of the high frequency resonance point of gypsum cement which is raised still higher by the addition of shale which, while optional, may be added to an extent of up to and including fifty percent. By laminating the gypsum cement/shale mixture to the high density particle board, which characteristically resonates at a much lower frequency, the result is a minimum reactance enclosure of high efficiency.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

I claim:

1. A speaker cabinet, comprising:

a cabinet having a substantially continuous outer surface defining the shape thereof, said cabinet having an opening therein in direct communication with a sound chamber defined by an inner surface of said cabinet, said sound chamber being designed to emit sound wave energy through said opening; and means associated with said inner surface of said cabinet to substantially preclude resonance of said cabinet, said cabinet having a first resonance frequency and said resonance precluding means including a rigid reinforcing liner having a second, higher resonance frequency, said reinforcing liner being substantially coextensive with said inner surface of said cabinet;

said cabinet including at least one wall defining an enclosure, said reinforcing liner comprising a layer of resonance resistant material laminated to said wall, said resonance resistant material being a cement-like mixture that expands as it sets, said cabinet also including a plurality of braces defining a frame to support said wall, said braces being formed of a substantially incompressible material, said resonance resistant material being disposed on said wall between said braces.

2. The speaker cabinet as defined by claim 1 wherein said cabinet includes a plurality of walls defining a box-like enclosure, said walls intersecting at substantially right angles, said box-like enclosure including a top wall, a bottom wall, a back wall, and a pair of side walls.

3. The speaker cabinet as defined by claim 2 wherein said plurality of braces are corner braces defining a box-like frame, each of said corner braces intersecting with two other corner braces at substantially right angles thereto, said box-like frame including one of said corner braces disposed at the intersection of each pair of said walls.

4. The speaker cabinet as defined by claim 1 wherein said resonance resistant material is a gypsum cement and shale mixture with the content of shale per unit volume of said mixture falling within the range of between zero percent and fifty percent.

5. The speaker cabinet as defined by claim 4 wherein said cabinet includes a plurality of holes in said wall thereof, said holes being larger near said outer surface of said cabinet than near said inner surface thereof, said holes being sized and shaped to receive said gypsum cement and shale mixture therein.

6. The speaker cabinet as defined by claim 5 wherein said holes in said wall of said cabinet are frustoconical in shape, said frustoconical holes serving to retain said layers of resonance resistant material on said wall, said layers of resonance resistant material being separated from said corner braces by means of an expansion joint formed of a compressible material.

7. The speaker cabinet as defined by claim 6 wherein said cabinet includes a veneer defining said outer surface, said veneer being applied to said wall so as to substantially entirely cover said walls, said opening being covered by a material permitting sound wave energy to pass therethrough.

8. The speaker cabinet as defined by claim 1 wherein said cabinet includes at least one wall defining an enclosure, said reinforcing liner comprising a layer of resonance resistant material laminated to said wall, said wall including means for retaining said layer of resonance resistant material on said wall.

9. The speaker cabinet as defined by claim 8 wherein said cabinet includes a frame to support said wall, said resonance resistant material being a cement-like mixture comprised of material which expands as it sets, said resonance resistant material being separated from said frame by means of an expansion joint.

10. A speaker cabinet, comprising:

a cabinet having a substantially continuous outer surface defining the shape thereof, said cabinet having an opening therein in direct communication with a sound chamber defined by an inner surface of said cabinet, said sound chamber being designed to emit sound wave energy through said opening; and means associated with said inner surface of said cabinet to substantially preclude resonance of said cabinet, said cabinet having a first resonance frequency and said resonance precluding means including a rigid reinforcing liner having a second, higher resonance frequency, said reinforcing liner being substantially coextensive with said inner surface of said cabinet;

said cabinet including at least one wall defining an enclosure and a frame to support said wall, said reinforcing liner comprising a layer of resonance resistant material laminated to said wall, said resonance resistant material being a cement-like mixture comprised of material which expands as it sets, said resonance resistant material being separated from said frame by means of an expansion joint.

* * * * *